US011898424B2

(12) United States Patent
Roessler

(10) Patent No.: US 11,898,424 B2
(45) Date of Patent: Feb. 13, 2024

(54) NON-EXPLOSIVE CASING PERFORATING DEVICES AND METHODS

(71) Applicant: GEODYNAMICS, INC., Millsap, TX (US)

(72) Inventor: Dennis Roessler, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 28 days.

(21) Appl. No.: 17/566,107

(22) Filed: Dec. 30, 2021

(65) Prior Publication Data

US 2022/0213766 A1 Jul. 7, 2022

Related U.S. Application Data

(60) Provisional application No. 63/134,434, filed on Jan. 6, 2021.

(51) Int. Cl.
*E21B 43/112* (2006.01)
*E21B 43/119* (2006.01)

(52) U.S. Cl.
CPC ..... *E21B 43/112* (2013.01); *E21B 43/119* (2013.01)

(58) Field of Classification Search
CPC ..... E21B 43/112; E21B 43/119
See application file for complete search history.

(56) References Cited

U.S. PATENT DOCUMENTS 2,381,929 A * 8/1945 Schlumberger ..... E21B 43/112 175/2
2,638,801 A * 5/1953 Klaasen ..... E21B 43/112 408/42
5,692,565 A * 12/1997 MacDougall ..... E21B 49/00 166/264
9,303,494 B2 * 4/2016 Pasvandi ..... E21B 29/06
2009/0194277 A1 * 8/2009 Burnett ..... E21B 43/122 166/55.1
2009/0211745 A1 * 8/2009 Christian ..... E21B 43/112 166/55.3
2011/0308803 A1 * 12/2011 O'Connell ..... E21B 43/26 166/308.1
2013/0048306 A1 * 2/2013 Antonsen ..... E21B 43/112 166/208
2015/0300135 A1 * 10/2015 Micak ..... E21B 43/112 166/55.3
2016/0237793 A1 * 8/2016 Albers ..... E21B 43/112
2017/0089184 A1 * 3/2017 Lohr, Sr. ..... E21B 43/116
2017/0335646 A1 * 11/2017 Huang ..... E21B 43/11
2019/0071955 A1 * 3/2019 Al-Anazi ..... E21B 43/08
2019/0120004 A1 * 4/2019 Castillo ..... E21B 43/119

(Continued)

*Primary Examiner* — Daniel P Stephenson
(74) *Attorney, Agent, or Firm* — Morgan, Lewis & Bockius LLP

(57) ABSTRACT

A non-explosive punch system for making perforations in a casing includes a housing and one or more punch elements configured to extend through a wall of the housing to perforate a casing of the well. An actuating device is located within the housing and may comprise a piston and an actuator block configured to actuate the one or more punch elements. An energy supply device is also located within the housing and may comprise a valve to direct fluid flow and a piston configured to use a pressure of a well fluid present in the casing, to actuate the actuating device. No explosive material is present in the punch system.

20 Claims, 10 Drawing Sheets

(56) References Cited

U.S. PATENT DOCUMENTS

| | | | | |
|---|---|---|---|---|
| 2020/0102794 | A1* | 4/2020 | Dallas | E21B 43/112 |
| 2020/0102815 | A1* | 4/2020 | Hrupp | E21B 43/119 |
| 2020/0190951 | A1* | 6/2020 | Teurlay | E21B 43/112 |
| 2021/0131225 | A1* | 5/2021 | Churchill | E21B 34/08 |
| 2021/0301633 | A1* | 9/2021 | Alnoaimi | E21B 43/263 |
| 2022/0106861 | A1* | 4/2022 | Watkins | E21B 43/1185 |
| 2022/0213766 | A1* | 7/2022 | Roessler | E21B 43/119 |

* cited by examiner

NON-EXPLOSIVE CASING PERFORATING DEVICES AND METHODS

BACKGROUND

Technical Field

Embodiments of the subject matter disclosed herein generally relate to a system and method for perforating the casing of a well, and more particularly, to a system that is capable of making perforations into a casing without using an explosive material.

Discussion of the Background

In the oil and gas field, once a well is drilled to a desired depth relative to the surface, and the casing protecting the wellbore has been installed and cemented in place, it is time to connect the wellbore to the subterranean formation to extract the oil and/or gas. This process of connecting the wellbore to the subterranean formation may include a step of plugging a previously fractured stage of the well with a plug, a step of perforating a portion of the casing, which corresponds to a new stage, with a perforating gun string such that various channels are formed to connect the subterranean formation to the inside of the casing, a step of removing the perforating gun string, and a step of fracturing the various channels of the new stage. These steps are repeated until all the stages of the formation are fractured.

During the perforating step for a given stage, one or more perforating guns of the perforating gun string are used to create perforation clusters in the multistage well. Clusters are typically spaced along the length of a stage (a portion of the casing that is separated with plugs from the other portions of the casing), and each cluster comprises multiple perforations (or holes). Each cluster is intended to function as a point of contact between the wellbore and the formation. Each perforation is made by a corresponding shaped charge, which is located inside the housing of the perforating gun. The shaped charge includes an explosive material which when ignited, melts a lining of the shaped charge and generates a travelling melted jet. The travelling melted jet is projected outward from the shaped charge, to make a perforation into the housing of the perforating gun and then a perforation into the casing of the well, to establish the fluid communication between the oil formation outside the well and the bore of the casing.

After each stage is perforated, a slurry of proppant (sand) and liquid (water) is pumped into the stage at high rates and then, through the perforation holes, into the formation, with the intent of hydraulically fracturing the formation to increase the contact area between that stage and the formation. A typical design goal is for each of the clusters to take a proportional share of the slurry volume, and to generate effective fractures, or contact points, with the formation, so that the well produces a consistent amount of oil, cluster to cluster and stage to stage.

However, the current methods of creating the perforations (casing holes) with explosives raise issues of safety, regulatory aspects, and require high equipment costs. Mechanical means of punching a hole in the casing exist, but these approaches are slow because they require power from the surface. Thus, there is a need for a new system for making perforations into the casing without using explosives or power from the surface, but also being fast enough for the well applications.

BRIEF SUMMARY OF THE INVENTION

According to an embodiment, there is a non-explosive punch system for making perforations in a casing. The non-explosive punch system includes a housing extending along a longitudinal axis and configured to be deployed in a well, one or more punch elements configured to extend through a wall of the housing to perforate a casing of the well, an actuating device located within the housing and configured to actuate the one or more punch elements, and an energy supply device located within the housing and configured to use a pressure of a well fluid present in the casing, to actuate the actuating device. There is no explosive material within the housing.

According to another embodiment, there is a method for manufacturing a non-explosive punch system for making perforations in a casing. The method includes providing a housing extending along a longitudinal axis and configured to be deployed in a well, adding one or more punch elements to the housing, wherein the one or more punch elements are configured to extend through a wall of the housing to perforate a casing of the well, installing an actuating device within the housing, the actuating device being configured to actuate the one or more punch elements, and fluidly connecting an energy supply device to a well fluid present in the casing and to the actuating device, to actuate the actuating device. There is no explosive material in the housing.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a single punch system that is used in a well for perforating the casing by not using energy from the surface. However, the embodiments to be discussed next are not limited to a single punch system, but may be applied to plural punch assemblies that are attached to each other.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a punch system uses exclusively a hydrostatic pressure present in the well for making perforations into the casing of the well. The punch system has a housing that hosts one or more punch elements configured to perforate the casing of a well. The one or more punch elements are actuated by an actuating device. The actuating device is supplied with energy for actuation by an energy supply device. The energy supply device harness the energy associated with the pressure of the well fluid in the casing and uses this energy to actuate the actuating device. No explosive charges and no power from the surface are used to actuate the punch element or to make the perforations.

Figure 1:
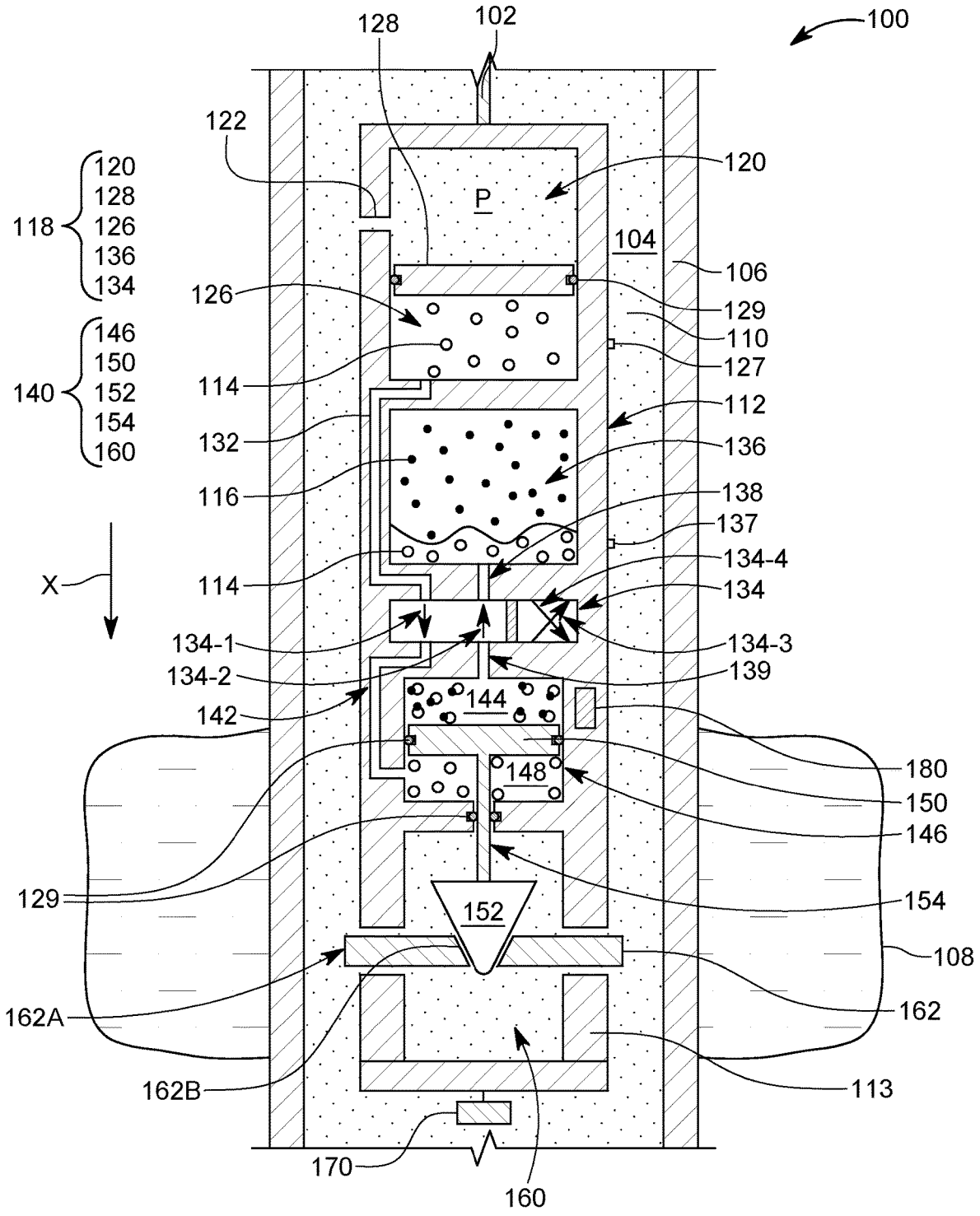
FIG. 1 is a schematic diagram of a non-explosive casing perforating device to be used in a well.

More specifically, as shown in FIG. 1, the punch system 100 is attached to a wireline 102 and lowered to a desired depth in a well 104 that is lined with a casing 106 (e.g., steel casing). The casing is surrounded by one or more formations 108 that might contain oil and gas. Perforations need to be made in the casing 106 to fluidly connect the formations 108 to the bore of the casing. The well 104 is filed with a well fluid 110, which due to the depth of the punch system, e.g., about 1.5 km or more, creates a hydrostatic pressure in excess of about 4,000 psi, which is enough for actuating the punch system 100.

To take advantage of this hydrostatic pressure P, a housing 112 of the punch system 100 hosts multiple devices that work together to generate a force that is used to puncture the casing. More specifically, the housing 112 hosts an energy supply device 118, an actuating device 140, and one or more punch elements 162. The energy supply device 118 transforms the hydrostatic pressure of the well fluid into a force that is supplied to the actuating device 140. The energy supply device 118 includes multiple chambers, for storing the well fluid 110, oil 114, and air 116. More specifically, the energy supply device 118 includes a hydrostatic chamber 120 that communicates through a passage 122 with the bore of the casing 106 so that the well fluid 110 can freely enter inside the hydrostatic chamber 120. The hydrostatic chamber 120 is separated from an oil chamber 126 by a floating piston 128. The floating piston 128 may include seals 129 to prevent the well fluid mixing with the oil and vice-versa. Note that the hydraulic chamber 120 has no other port for communicating with the ambient, except for the passage 122. The oil chamber 126 also has a single oil communication passage 132, extending through a wall of the casing 112. The oil passage 132 extends through a wall of the housing, from the oil chamber 126 to a valve assembly 134. The valve assembly 134, which is also part of the energy supply device 118, may include one 4-ways valve, or two 3-ways valves or four 2-ways valves or any other combination of valves. In one embodiment, the valve assembly includes solenoid valves. The valve assembly 134 schematically shows in FIG. 1 the two different states, that correspond to four possible paths for the various fluids in the punch system. The two states of the valve assembly 134 include a retracting state, which is characterized by fluid paths 134-1 and 134-2, and a punching state, which is characterized by fluid paths 134-3 and 134-4. These arrows are discussed in more detail later.

The energy supply device 118 further includes an air chamber 136, which is configured to initially hold the air 116 at atmospheric pressure. However, as the punch system 100 makes perforations into the casing, oil is slowly directed into the bottom of the air chamber 136, as schematically indicated in FIG. 1. When the amount of oil 114 becomes too high, the punch system needs to be recharged, as discussed later. Note that when the punch system 100 is initially lowered into the well, the air 116 in the air chamber 136 is at atmospheric pressure. The air chamber 136 has a corresponding air communication passage 138 that communicates with the valve assembly 134. The oil passage 132 and the air passage 138 are connected on the same side of the valve assembly 134, to corresponding first and second ports, i.e., when one passage is activated, the other passage is also activated. In other words, the two passages are simultaneously activated by the valve assembly 134.

On the other side of the valve assembly 134, there are two other communication passages that fluidly communicate corresponding third and fourth ports with the actuating device 140. A first communication passage 139 fluidly connects the third port of the valve assembly 134 to a first chamber 144 of a double action enclosure 146 (which is part of the actuating device 140), and a second communication passage 142 fluidly connects the fourth port of the valve assembly 134 to a second chamber 148 of the double action enclosure 146. The first chamber 144 is separated from the second chamber 148 by a double action piston 150. Seals 129 are provided around the double action piston 150 for preventing a fluid to move from the first chamber to the second chamber or vice versa. After the punch system 100 is used in the well, both the first and second chambers 144 and 148 include oil 114. The double action piston may be replaced with 2 pistons opposing each other.

The double action piston 150, which is part of the actuating device 140, is connected to an actuator block 152 (e.g., a wedge-shaped block, but other more complex shapes may be used) through a rod 154. The rod 154 extends through the second chamber 148 and enters into an actuation chamber 160, which is also part of the actuating device 140, where it is connected to the actuator block 152. Seals 129 are provided around the rod 154 for preventing the oil 114 from the second chamber to mix with the well fluid 110 that is present inside the actuation chamber 160. The actuator block 152 may contact one or more punch elements 162 that extend through a wall 113 of the housing 112, from the interior of the actuation chamber 160, into the bore of the casing 106, as illustrated in FIG. 1. Note that the punch elements 162 are not sealed against the wall of the housing 112 and thus, the well fluid 110 from outside the punch system 100 can freely enter inside the actuation chamber 160. Further, the punch elements 162 have a first distal end 162A, that is configured to make a perforation into the casing 106, when actuated by the actuation block 152. In one application, the distal end 162A may be shaped as a blade, needle, cone, etc. The proximal end 162B may be shaped to match a profile of the actuator block 152, as schematically illustrated in the figure. In one embodiment, as illustrated in FIG. 2, the proximal end 162B is mechanically and slidably attached to the actuator block 152.

Figure 2:
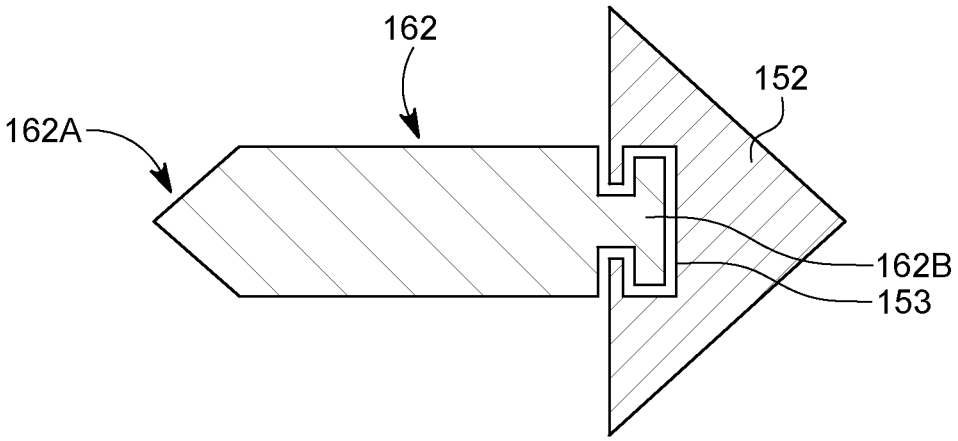
FIG. 2 illustrates a connecting mechanism between one or more punch elements and an actuating block of the non-explosive casing perforating device.
Figure 3A:
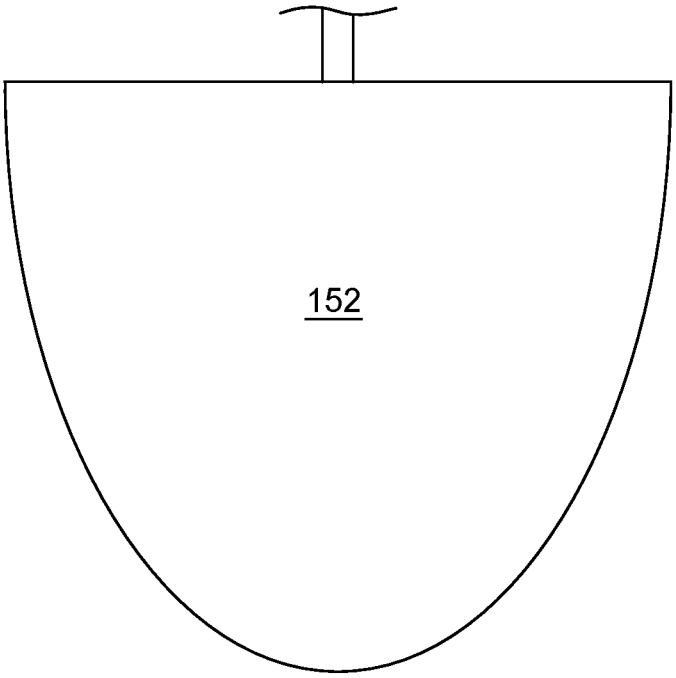
FIGS. 3A and 3B illustrate various shapes of the actuating block of the non-explosive casing perforating device.
Figure 3B:
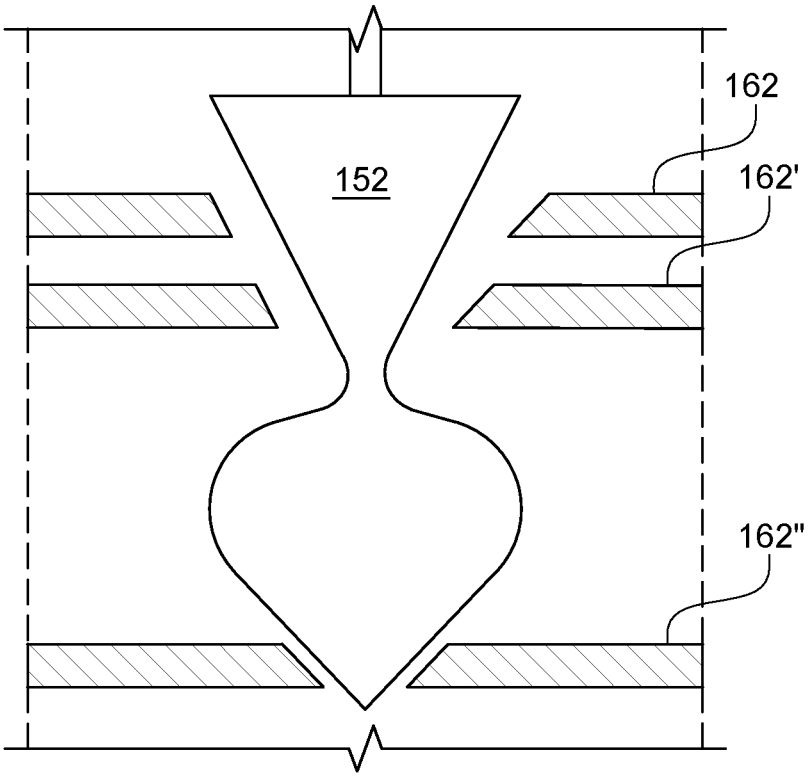

More specifically, FIG. 2 shows a groove 153 formed in the body of the actuator block 152 and the groove extends along a length direction of the block. The punch element 162 has a pointy distal end 162A while the proximal end 162B is shaped to fit inside the groove 153 and be locked there. The groove 153 is shaped to hold the proximal end 162B inside while the actuator block 152 moves along a length of the housing 112, i.e., the longitudinal axis X in FIG. 1. Note that this arrangement allows the punch element 162 to move perpendicular to the casing 106 while also sliding along the actuator block 152, but at the same time this arrangement forces the punch element 162 to perforate the casing 106 when the actuator block 152 is moving away from the head of the well. In this way, a downstream movement (i.e., toward the tail of the well) by the actuator block forces the punch element 162 to move toward the casing 106 to puncture it (the punching state), and an upstream movement (i.e., toward the head of the well) of the actuating block 152 retrieves the punch element 162 to its original position, i.e., mainly inside the housing 112 (the retrieved state). In one application, the groove 153 may be replaced with another connecting mechanism, for example, a spring or similar device. In one application, the punch element is fully within the housing 112 in the retrieved state. Any number of punching elements may be provided in the actuation chamber 160. The punching elements may be angularly distributed around the actuator block 152, with 60-, 90-, 120- or 180-degrees angle separation. The actuator block 152 may be round, as shown in FIG. 3A, or may have multiple stages as illustrated in FIG. 3B, for being able to actuate various layers of punch elements 162, 162', and 162". Those skilled in the art would understand that any number of punch elements may be used.

Figure 4:
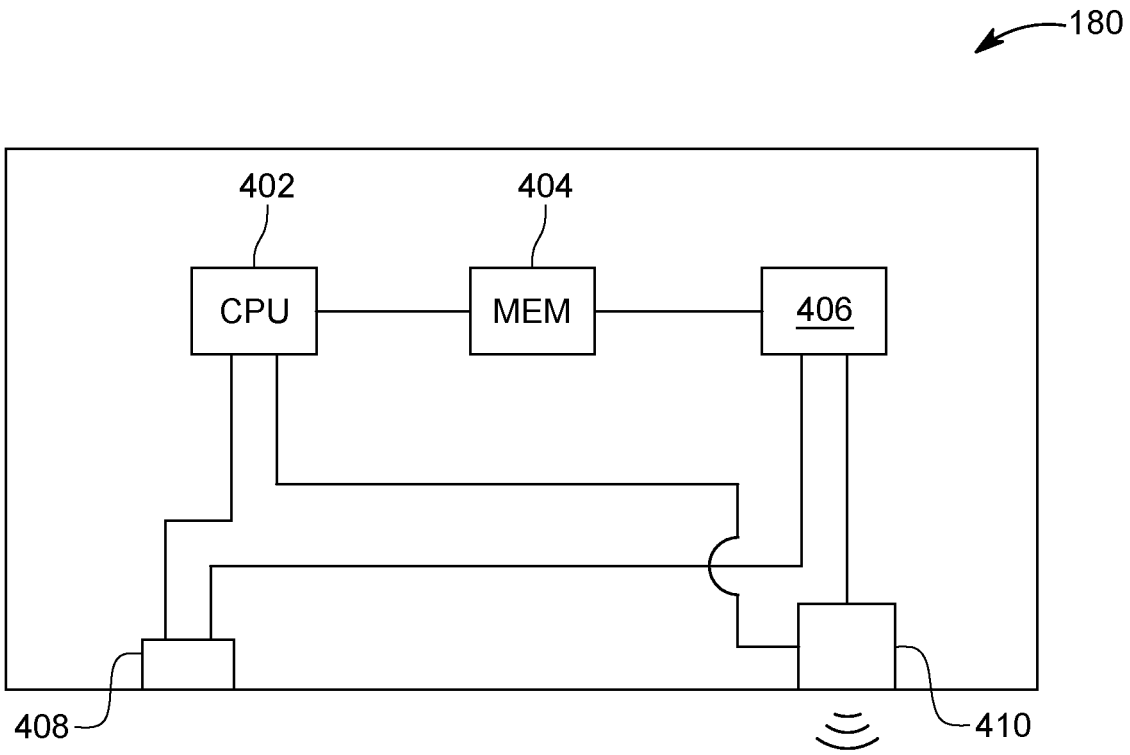
FIG. 4 is a schematic diagram of a controller of the non-explosive casing perforating device.

Returning to FIG. 1, the punch system 100 may have only the chambers shown, or, may have a plurality of these chambers, i.e., the structure shown in FIG. 1 may be repeated, in series, to have a multiple-stage system, with each system being hydraulically activated independent of the other stages, and with each stage being able to puncture the casing of the well independent of the other stages. An end of the casing 112 of the punch system 100 may be closed or not. A plug setting tool 170 is schematically illustrated in the figure as being attached to the end of the punch system. The setting tool 170 may be connected to a setting plug (not shown). Although FIG. 1 shows the punch system 100 being connected to the wireline 102, in one embodiment, this connection may be removed so that the punch system is autonomous. In this case, a local controller 180 may include, as schematically indicated in FIG. 4, a processor 402, a memory 404, a power source 406 (for example, a battery), a pressure sensor 408 or other similar sensors, and communication means (for example, an acoustic modem) 410 for communicating with a general controller (not shown) located at the surface. The pressure sensor 408 may be used to determine a depth of the punch system, and the processor may run a software stored in the memory, to activate the valve assembly 134, and thus, the actuator block 152 when the desired depth is reached. In one application, the processor 402 is configured to control the valve assembly 134, so that the punching state or the retrieved state is selected. For this case, the punch system 100 moves independently towards the tail of the well, due to the gravity, or, if in a horizontal well, the well may be pumped to move the punch system to the desired depth. The punch system may be brought to the surface with a fishing tool, or with a simple cable that is attached to the housing 112. However, this cable does not have any electrical or hydraulic capabilities.

Figure 5:
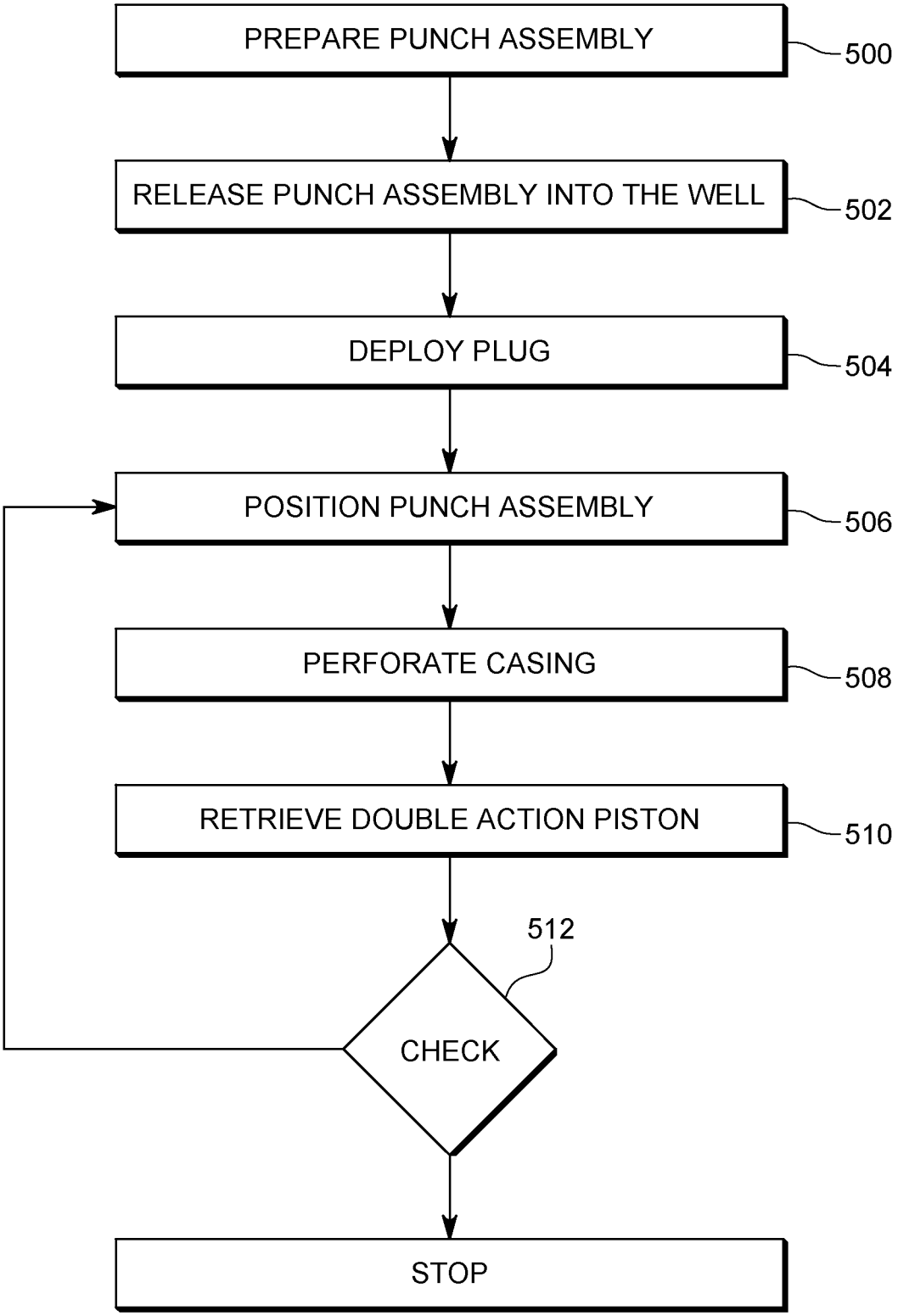
FIG. 5 is a flow chart of a method of perforating a casing in a well with the non-explosive casing perforating device.

A method for using the punch system 100 is now discussed with regard to FIG. 5. In step 500, the punch system 100 is prepared for being lowered into the well. This step includes filling the oil chamber 126 with oil, for example, through a filing port 127 and placing the valve assembly 134 in the retrieved state. Also, the air chamber 136 is filed with air at atmospheric pressure and any oil present in this chamber is removed trough a port 137. In one application, an external pump is connected between the two ports 127 and 137 to transfer all the oil from the air chamber back to the oil chamber. If the punch system is launched into the well with a wireline, the wireline is attached to its housing. Next, in step 502, the punch system 100 is released into the well and allowed to move to the desired depth. The desired depth may be determined either by measuring the metered wireline or by using a sensor (e.g., pressure sensor 408) for calculating the depth. Once the desired depth is reached, the setting tool is instructed, through the wireline, or by the processor 402 if the punch system is autonomous, to deploy in step 504 the associated plug, to seal a stage from a previous stage. Then, in step 506, the punch system moves to a certain distance from the plug and the processor 402 instructs the valve assembly 134 to switch from the retrieved state to the punching state, to perforate the casing. The valve assembly 134 is shown in FIG. 1 being in the retrieved state, i.e., the oil 114 from the oil chamber 126 is directed to the second chamber 148 to push the double action piston 150 upstream, to decrease a volume of the first chamber 144 and increase a volume of the second chamber 148.

Figure 6:
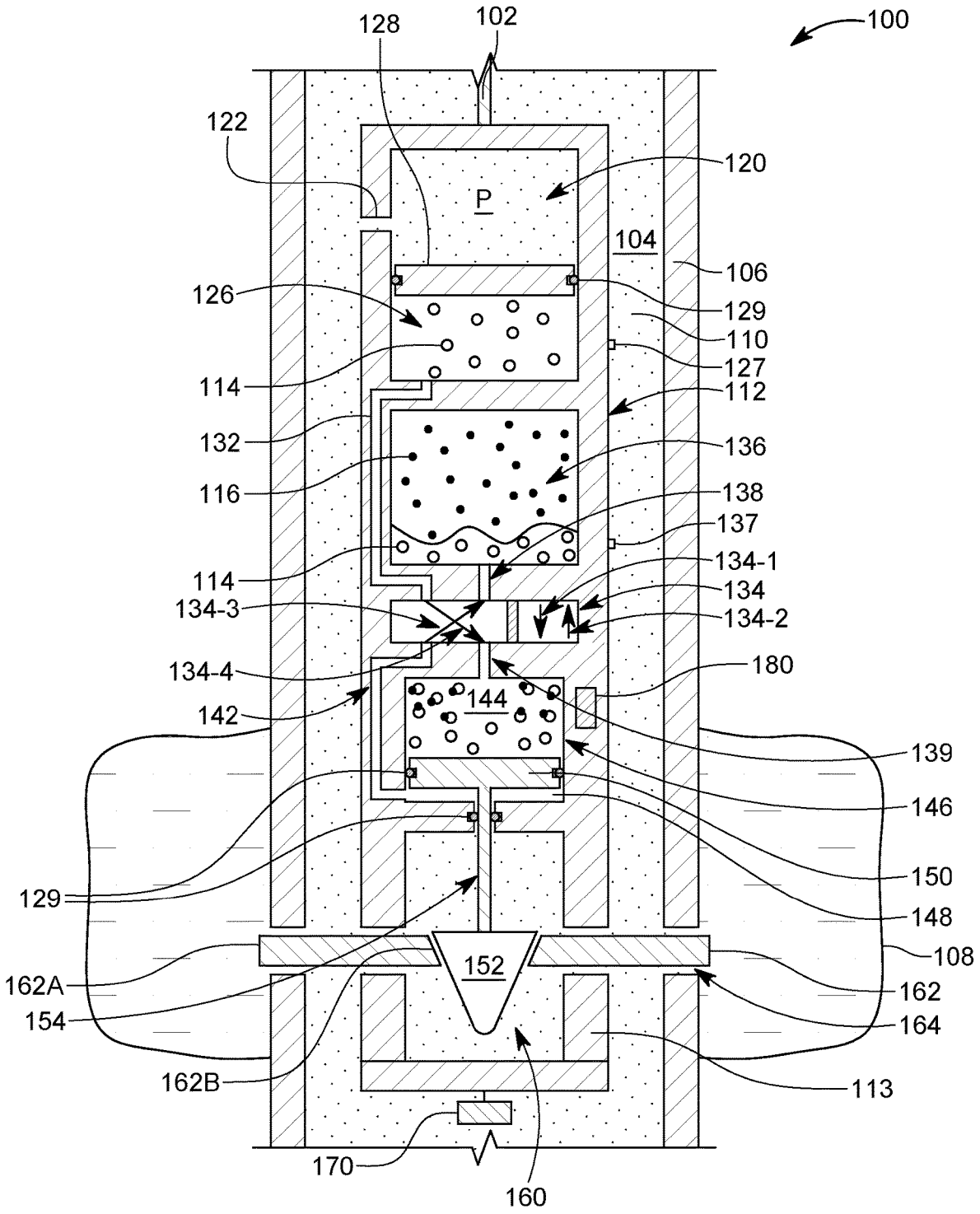
FIG. 6 illustrates the non-explosive casing perforating device in a punching state.

When the valve assembly 134 is moved to the punching state, i.e., during the perforation step 508, as shown in FIG. 6, the oil from the oil chamber 126 moves under the pressure of the well fluid 110, exerted through the floating piston 128, along the oil passage 132 and through the path 134-4 into the first chamber 144 of the double action enclosure 146. This means that the high hydrostatic pressure P exerted by the well fluid 110 is transferred to the top of the double action piston 150. As the piston 150 starts moving downstream, the oil present in the second chamber 148 of the double action enclosure 146 moves through the channel 142, path 143-3, and channel 138 into the air chamber 136. Note that as the air 116 in the air chamber 136 is at atmospheric pressure and the oil 114 in the first chamber is at the high hydraulic pressure of about 4000 psi, the double action piston 150 starts moving downstream, so that the actuating block 152 starts to push away the punch elements 162. As the pressure difference between the air in the air chamber and the well fluid is large, and this pressure is carried by the oil on top of the double action piston 150, there is a large force exerted by the actuator block 152 onto the punch elements 162, so that their pointy heads 162A are able to perforate the casing 106 as shown in FIG. 6, and form corresponding perforations 164.

Figure 7:
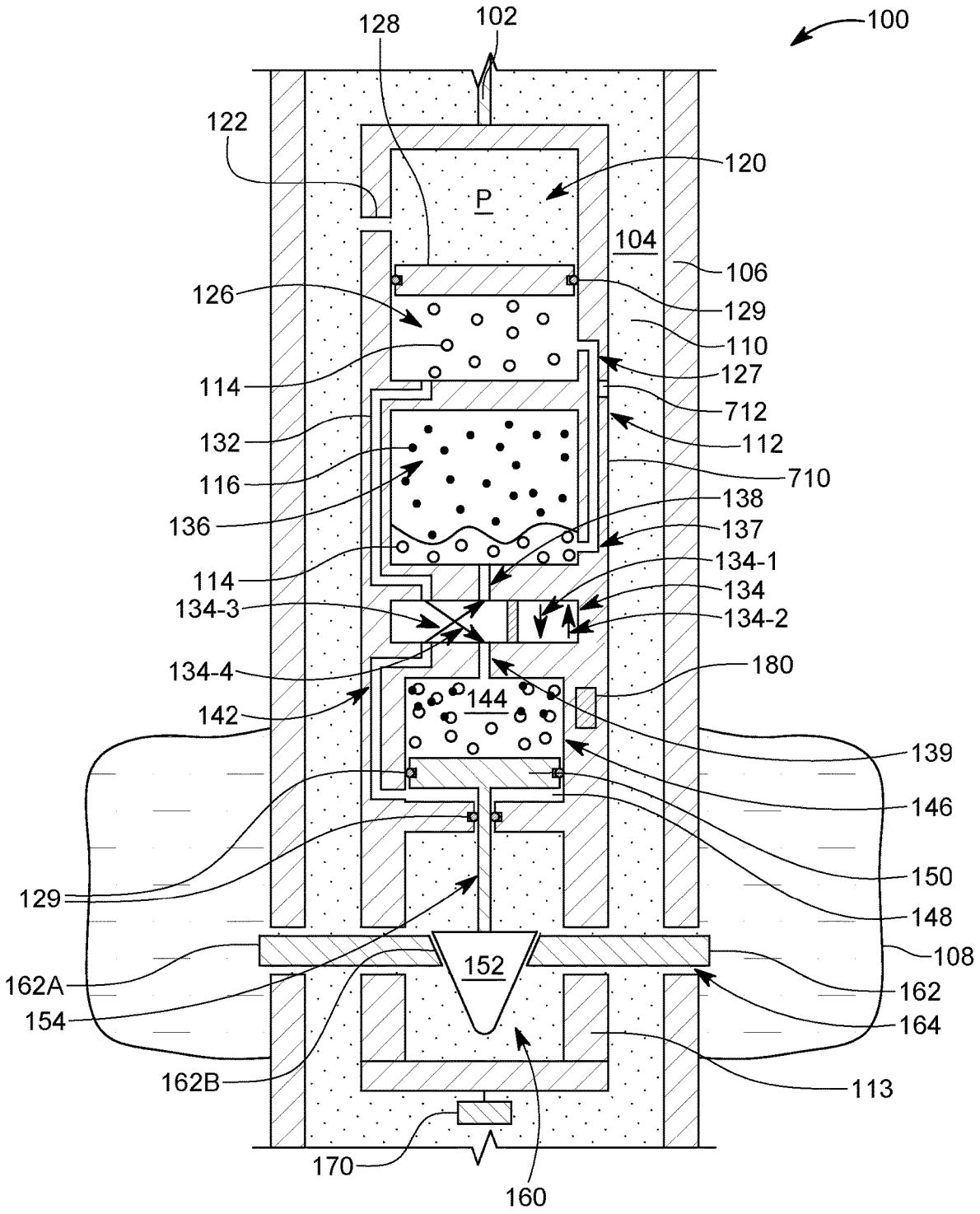
FIG. 7 illustrates the non-explosive casing perforating device having an oil moving mechanism for removing the oil from an air chamber and returning it to the oil chamber.

Next, the double action piston 152 is retrieved in step 510, to prepare the punch system for a next perforation. This means that in step 510 the processor 402 instructs the valve assembly 134 to return to the retrieved state shown in FIG. 1, so that the oil under pressure from the oil chamber 120 enters now through the path 134-1 and passage 142 into the second chamber 148, and pushes the double action piston 150 in an upstream direction, to increase the volume of the second chamber 148 and to decrease the volume of the first chamber 144. The oil from the first chamber 144 is now squeezed through the passage 139, path 134-2 and the passage 138 into the air chamber 136. This means that the punch system may be used multiple times, as long as the oil that enters into the first chamber 144 in step 506 can be discharged into the air chamber 136 during the step 510. This also means that a large oil chamber 120, a large air chamber 126, and a smaller first chamber 144 would determine how many times the punch system may be used before it needs to be taken up to the surface, to remove the oil from the air chamber and refill the oil chamber. In one embodiment, as illustrated in FIG. 7, a conduit 710 may connect the port 127 in the oil chamber 120 to the port 137 in the air chamber 136, and a pump 712 may be located within the housing 110, so that the pump 712 pumps the oil from the air chamber back into the oil chamber while the punch system is deployed inside the well. In this way, there is no need to take the punch system back to the surface for recharging it and thus, the casing punching may continue for as long as necessary. The pump 712 may be feed with electrical power through the wireline 102, or, if the punch system is autonomous, from the power source 406.

After each punch is made in the casing, a volume of oil effectively moves from the oil chamber into the air chamber. The amount of oil depends on the piston 150's area and its stroke. The volumes of the air chamber and oil chamber are selected to be large enough so that many holes (e.g., 30+) can be punched in a single run of the punch system. Since a plug is installed at the bottom of each stage, there is an optimum number of holes to be punched per stage. This system is designed to supply at least this many holes per run. As the oil enters the air chamber, the air pressure increases. The air chamber needs to have a large enough volume so that the air pressure increase is not significant. After all of the holes are punched for a given stage, the punch system may be removed, i.e., drawn uphole by the wireline. The punctured stage may be frac-ed while the punch system is being reset for another run. This consists of moving the floating piston to its initial position and moving the oil from the air chamber into the oil chamber. Also, another plug is attached to the bottom of the assembly. At the surface, an external pump can be connected to the external ports 127 and 137 to drain the oil out of the air chamber, and return it to the oil chamber. The oil moving into the oil chamber would automatically move the floating piston 128 to its initial position. The number of holes that can be punched in each run is controlled by the volume of these chambers.

Returning to FIG. 5, after the double action piston 150 has been retrieved in step 510, the processor 402 or the operator of the system checks in step 512 whether more perforations are necessary to be performed. If the answer is yes, then the process returns to step 506, to move the punch system to a new location and form new perforations. If the answer is no, then the process stops and the punch system is returned to the surface.

Figure 8:
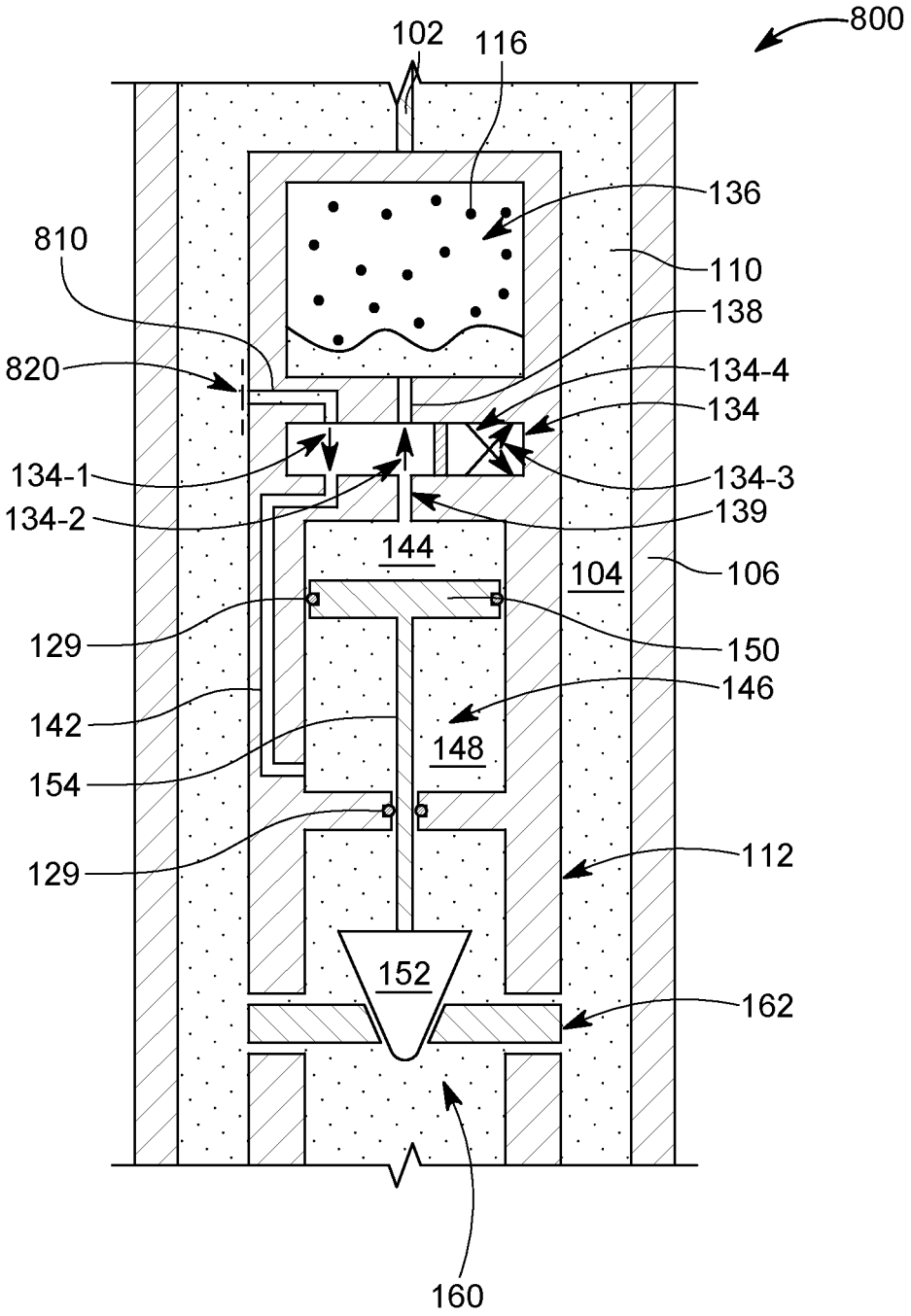
FIG. 8 illustrates another implementation of the non-explosive casing perforating device.

In a different embodiment, as illustrated in FIG. 8, a punch system 800 is configured to work without the oil chamber 126 and the floating piston 128. More specifically, the air chamber 136 is located at the top of the housing 112 and communicates through the passage 138 with a first port the valve assembly 134. A well fluid communication passage 810 fluidly communicates the well fluid 110 in the bore of the casing 106, with a second port of the valve assembly 134. The valve assembly 134 is identical to the one illustrated in the embodiment of FIG. 1 and thus, its description is omitted herein. However, it is noted that in the retracted state, the well fluid moves through the passage 810, through the valve assembly 134, and passage 142 and enters the second chamber 148 of the double action enclosure 146, thus biasing the floating piston 150 to not activate the punch elements 162. However, when the valve assembly 134 changes to the punching state, the well fluid from the casing enters through the passage 810 and the passage 139 into the first chamber 144 of the double action enclosure 146, thus acting with a force on top of the double action piston 150. The well fluid already present in the second chamber 148 is now pushed through the passage 142 into the air chamber 136, thus allowing the piston 150 to move in the downstream direction. The movement of the piston 150 makes the actuation block 152 to also move downstream, and thus, to extend the punch elements 162 toward the casing 106 as in the embodiment shown in FIG. 1. As the pressure difference between the well fluid and the air in the air chamber is very large, the force exerted by the punch elements 162 onto the casing 106 is large enough to perforate the casing, similar to the embodiment illustrated in FIG. 1. Note that the connections between the punch elements 162 and the actuating block 152 are similar to those discussed above with regard to FIG. 1.

To prevent debris from the casing 106 to enter together with the well fluid 110 into the passage 810, a screen 820 may be placed at the inlet of the passage 810. All the features discussed above with regard to FIG. 1 are also applicable for this embodiment. The punch system 800 may be used in a similar way as the punch system 100, and thus, a method of using this punch system follows the method illustrated in FIG. 5.

Figure 9:
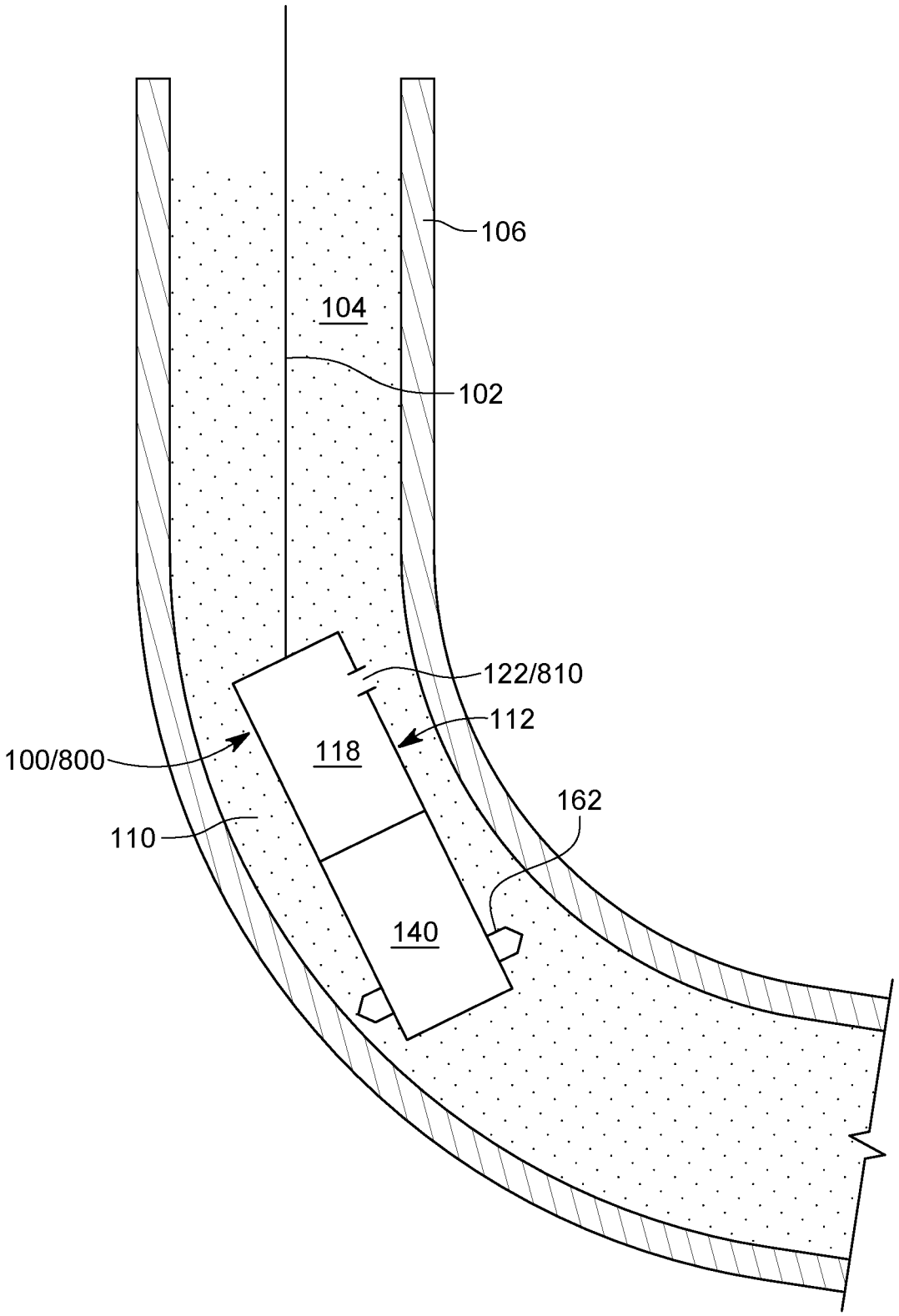
FIG. 9 illustrates the non-explosive casing perforating device being deployed in the well.

FIG. 9 generically illustrates the main parts of the punch system 100/800, i.e., the housing 112 that holds the energy supply device 118, the actuating device 140, and the one or more punch elements 162. Note that the energy supply device 118 has a passage 122/810 that allows the well fluid 110 to freely enter inside the housing and inside the energy supply device 118. The energy of this fluid is harnessed by the energy supply device to drive the one or more punch elements 162 to perforate the casing 106.

Figure 10:
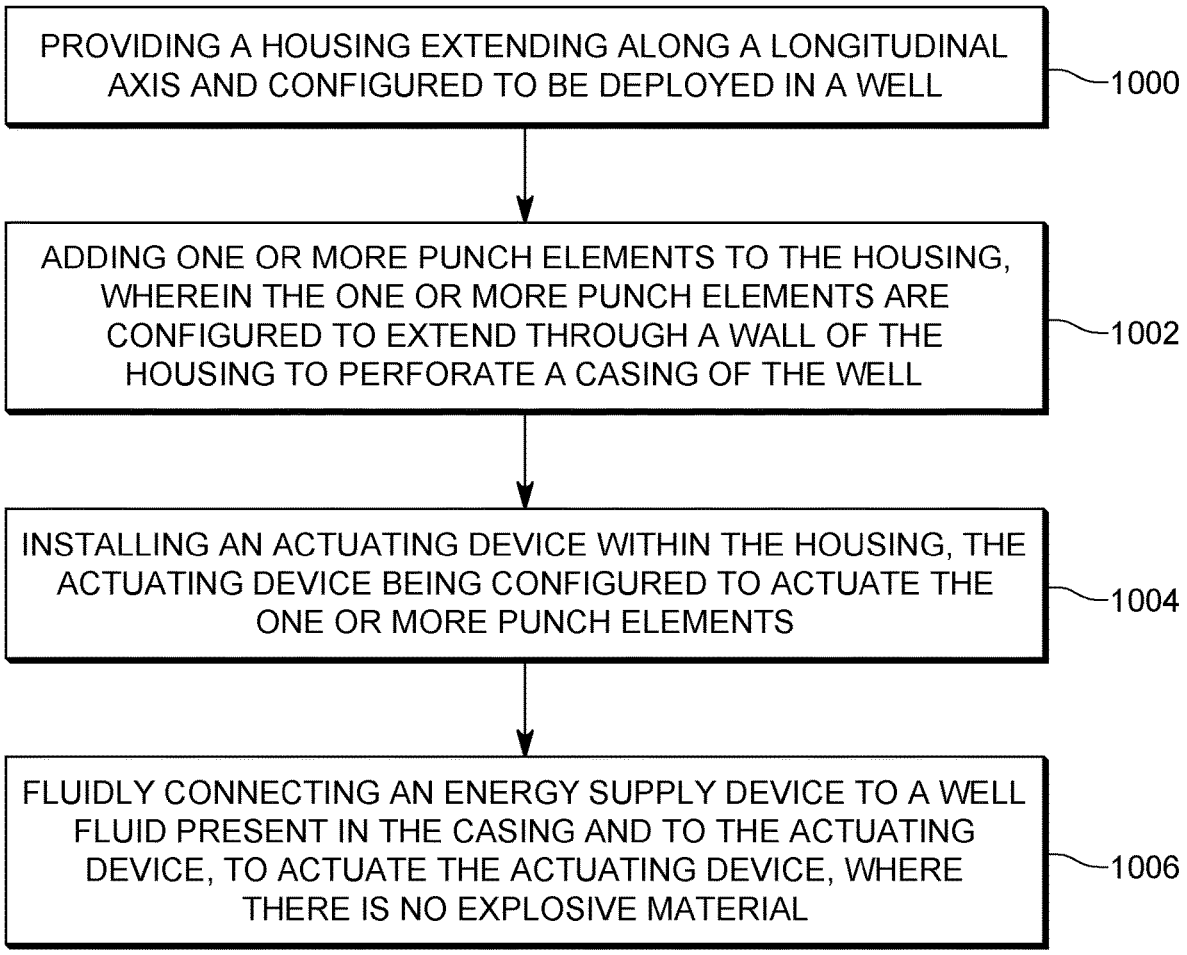
FIG. 10 is a flow chart of a method for manufacturing the non-explosive casing perforating device.

A method for manufacturing a non-explosive punch system 100 for making perforations in a casing is now discussed with regard to FIG. 10. The method includes a step 1000 of providing a housing extending along a longitudinal axis and configured to be deployed in a well, a step 1002 of adding one or more punch elements to the housing, wherein the one or more punch elements are configured to extend through a wall of the housing to perforate a casing of the well, a step 1004 of installing an actuating device within the housing, the actuating device being configured to actuate the one or more punch elements, a step 1006 of fluidly connecting an energy supply device to a well fluid present in the casing and to the actuating device, to actuate the actuating device, where there is no explosive material. The energy supply device includes a hydrostatic chamber, an oil chamber and an air chamber, wherein the hydrostatic chamber is open to a bore of the casing and holds the well fluid, wherein the oil chamber stores oil and is separated from the hydrostatic chamber by a floating piston, and wherein a valve assembly is fluidly connected at a first port with the oil chamber and fluidly connected at a second port with the air chamber.

The disclosed embodiments provide a non-explosive casing perforation system that uses an existing hydrostatic pressure to punch holes into the casing. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A non-explosive punch system for making perforations in a casing, the non-explosive punch system comprising:

a housing extending along a longitudinal axis and configured to be deployed in a well;

one or more punch elements configured to extend through a wall of the housing to perforate a casing of the well;

an actuating device comprising a piston located within the housing and configured to actuate the one or more punch elements; and an energy supply device comprising a valve located within the housing and configured to selectively direct pressurized fluid to the piston, wherein there is no explosive material.

2. The punch system of claim 1, wherein the energy supply device further comprises a hydrostatic chamber, an oil chamber and an air chamber.

3. The punch system of claim 2, wherein the hydrostatic chamber is open to a bore of the casing and is configured to hold the well fluid.

4. The punch system of claim 3, wherein the oil chamber is configured to store oil and is separated from the hydrostatic chamber by a floating piston.

5. The punch system of claim 4, wherein the valve comprises a first port fluidly connected to the oil chamber and a second port fluidly connected to the air chamber.

6. The punch system of claim 1, wherein the actuating device further comprises:

a double action enclosure that fluidly communicates with the energy supply device;

an actuating block configured to directly press on the one or more punch elements.

7. The punch system of claim 6, wherein the one or more punch elements is mechanically connected to the actuation block.

8. The punch system of claim 6, wherein a movement of the actuating block along the longitudinal axis forces the one or more punch elements to move along a line perpendicular to the longitudinal axis.

9. The punch system of claim 8, wherein the actuating block is located within an actuation chamber, which is located within the housing, and the actuation chamber is sealed from the double action enclosure.

10. The punch system of claim 6, wherein the piston separates the double action enclosure into first and second chambers, the first chamber is fluidly connected to a port of the valve and the second chamber is fluidly connected to another port of the valve.

11. The punch system of claim 1, wherein the energy supply device further comprises a hydrostatic chamber, an oil chamber and an air chamber, the hydrostatic chamber is open to a bore of the casing and holds the well fluid, the oil chamber stores oil and is separated from the hydrostatic chamber by a floating piston, wherein the valve is fluidly connected at a first port with the oil chamber and fluidly connected at a second port with the air chamber, wherein the actuating device further comprises a double action enclosure that fluidly communicates with the energy supply device and an actuating block configured to directly press on the one or more punch elements, and wherein the actuating block is located within an actuation chamber, located within the housing, and the actuation chamber is sealed from the double action enclosure.

12. The punch system of claim 11 wherein the piston separates the double action enclosure into first and second chambers, the first chamber is fluidly connected to a third port of the valve and the second chamber is fluidly connected to a fourth port of the valve.

13. The punch system of claim 11, further comprising:

a first passage fluidly connecting the oil chamber to the first port; and a second passage fluidly connecting the air chamber to the second port.

14. The punch system of claim 13, wherein the oil from the oil chamber is directed, in a retrieving state, into the second chamber to retrieve the piston, and in a punching state, into the first chamber to actuate the piston.

15. The punch system of claim 1, wherein the energy supply device further comprises an air chamber configured to hold air, a first passage fluidly connecting an outside of the housing to a first port of the valve, and a second passage fluidly connecting the air chamber to a second port of the valve.

16. The punch system of claim 15, wherein the actuating device further comprises:

a double action enclosure that fluidly communicates with third and fourth ports of the valve; and an actuating block configured to directly press on the one or more punch elements.

17. The punch system of claim 16, wherein the actuating block is located within an actuation chamber, located within the housing, and the actuation chamber is sealed from the double action enclosure.

18. The punch system of claim 16, wherein the piston separates the double action enclosure into first and second chambers, the first chamber is fluidly connected to the third port of the valve and the second chamber is fluidly connected to the fourth port of the valve.

19. A method for manufacturing a non-explosive punch system for making perforations in a casing, the method comprising:

providing a housing extending along a longitudinal axis and configured to be deployed in a well;

adding one or more punch elements to the housing, wherein the one or more punch elements are configured to extend through a wall of the housing to perforate a casing of the well;

installing within the housing an actuating device comprising a piston configured to actuate the one or more punch elements; and fluidly connecting an energy supply device comprising a valve to a well fluid present in the casing and to the piston, wherein there is no explosive material.

20. The method of claim 19, wherein the energy supply device further comprises a hydrostatic chamber, an oil chamber and an air chamber, wherein the hydrostatic chamber is open to the bore of the casing and holds the well fluid, wherein the oil chamber stores oil and is separated from the hydrostatic chamber by a floating piston, and wherein the valve is fluidly connected at a first port with the oil chamber and fluidly connected at a second port with the air chamber.

* * * * *